US005630298A

United States Patent [19]

Tsai et al.

[11] Patent Number: 5,630,298

[45] Date of Patent: May 20, 1997

[54] SHEAR LINK ENERGY ABSORBER

[75] Inventors: Keh-Chyuan Tsai, Taipei; Ray-Jeng Wang, Chiai, both of Taiwan

[73] Assignee: National Science Council, Taipei, Taiwan

[21] Appl. No.: 523,549

[22] Filed: Sep. 5, 1995

[51] Int. Cl.[6] ..... E04H 9/02

[52] U.S. Cl. ..... 52/167.3; 52/167.1; 52/729.2

[58] Field of Search ..... 52/167.1, 167.2, 52/167.3, 167.4, 167.5, 167.6, 729.1, 729.2, 731.1, 731.7, 731.8

[56] References Cited

U.S. PATENT DOCUMENTS

| | | | |
|---|---|---|---|
| 1,574,563 | 2/1926 | Duff | 52/729.2 X |
| 4,047,341 | 9/1977 | Bernardi | 52/729.1 |
| 4,328,648 | 5/1982 | Kalpins | 52/167.4 |
| 4,766,706 | 8/1988 | Caspe | 52/167.4 X |
| 4,823,522 | 4/1989 | White | 52/167.4 X |
| 5,533,307 | 7/1996 | Tsai et al. | 52/167.3 |

FOREIGN PATENT DOCUMENTS

| | | | |
|---|---|---|---|
| 2-248577 | 10/1990 | Japan | 52/167.3 |
| 1705504 | 1/1992 | U.S.S.R. | 52/167.5 |

*Primary Examiner*—Carl D. Friedman
*Assistant Examiner*—Kevin D. Wilkens
*Attorney, Agent, or Firm*—Michael D. Bednarek; Kilpatrick Stockton LLP

[57] ABSTRACT

A shear link energy absorber comprises a base plate, an I-shaped beam, a fixture, at least one connecting plate and a plurality of bolts. The I-shaped beam has a pair of flange plates and a web plate positioned between the flange plates. The fixture has a bottom plate and two side plates parallel connected to the bottom plate. The base plate is connected to one end of the I-shaped beam while the connecting plate connected to the other end of the I-shaped beam. The plurality of bolts bolt the connecting plate and the fixture together.

7 Claims, 8 Drawing Sheets

SHEAR LINK ENERGY ABSORBER

BACKGROUND OF THE INVENTION

1. Field Of The Invention

The present invention relates to a shear link energy absorber. More particularly, the present invention relates to an economical and safe shear link energy absorber.

2. Description Of The Prior Art

Safety is the first consideration in a structure's design. According to conventional designs, a building structure should sufficiently resist a general external force without suffering a diminution of structural integrity. Furthermore, the building must not collapse if a strong earthquake occurs. However, conventional designs have their common problems: The ductility capacity of the beams and columns of the building structures may be inadequate during a strong earthquake. The beams and columns of the building structures need to be replaced if they fracture or deform too excessively. A strong seismic load may also cause non-structural damage to the building and the foundation work that is expensive to repair.

To solve the above problems, various seismic energy dissipation devices have been developed over the past few years. The seismic energy dissipation devices were mounted in building structures to dissipate earthquake-induced energy and to protect the buildings. The present invention was developed for the same purpose. The main part of the present invention to dissipate seismic energy is an I-shaped beam.

SUMMARY OF THE INVENTION

An object of the present invention is to provide a shear link energy absorber which mainly uses an I-shaped beam to dissipate seismic energy. The I-shaped beam is widely available, easily produced and mounted. Furthermore, the I-shaped beam dissipates energy well. Accordingly this invention has the merits of economy and safety.

In accordance with the object of this invention, a shear link energy absorber is provided, which comprises a base plate, an I-shaped beam, a fixture, at least one connecting plate and a plurality of bolts. The I-shaped beam has a pair of flange plates and a web plate positioned between the flange plates. The fixture has a bottom plate and two side plates parallel connected to the bottom plate. The base plate is connected to one end of said I-shaped beam while the connecting plate is connected to the other end of said I-shaped beam. The plurality of bolts bolt the connecting plate and the fixture together.

DESCRIPTION OF THE PREFERRED EMBODIMENT

Figure 1:
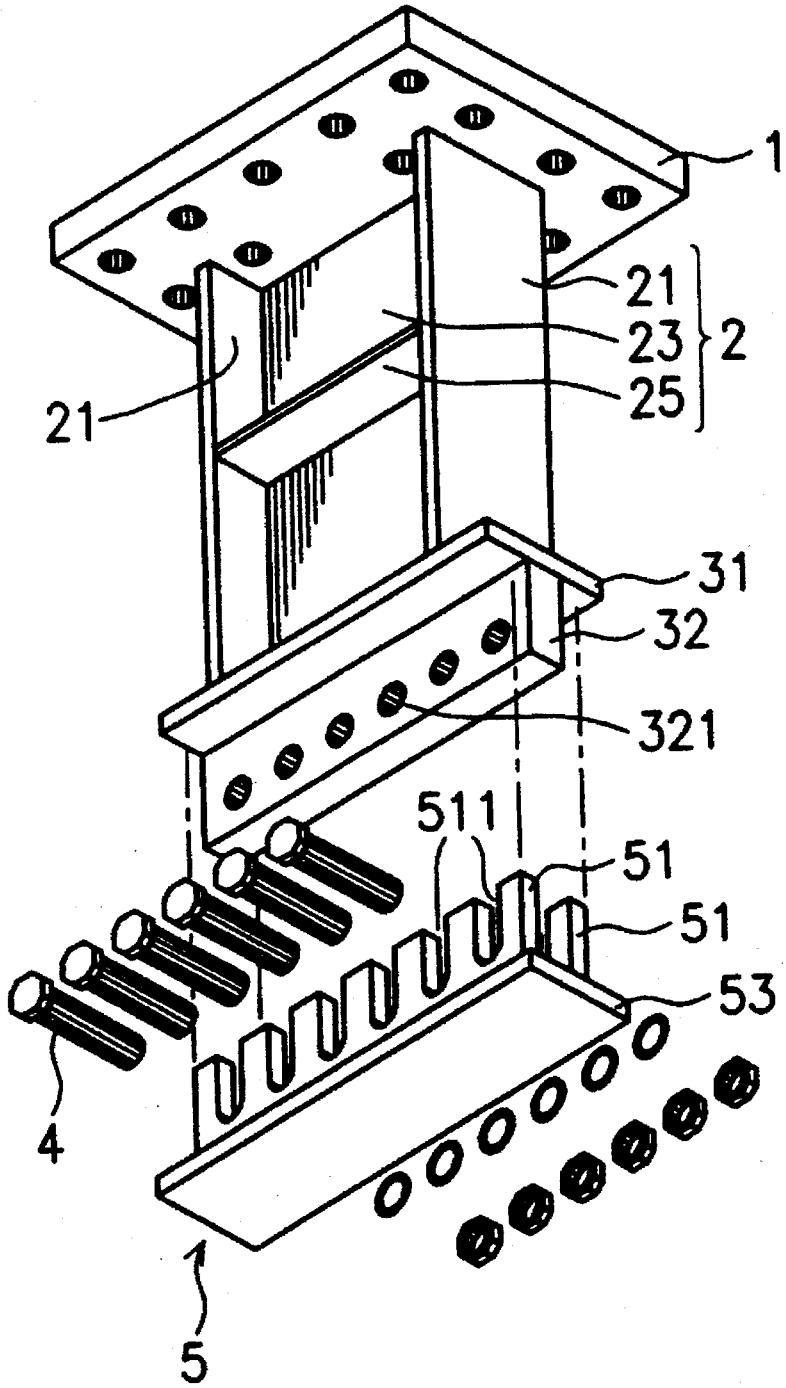
FIG. 1 is a perspective exploded diagram of the shear link energy absorber according to the first embodiment of the present invention.

As shown in FIG. 1, a shear link energy absorber according to the first embodiment of the present invention comprises a base plate 1, an I-shaped beam 2, two connecting plates 31 and 32, a plurality of high-strength bolts 4 and a fixture 5.

The I-shaped beam 2 comprises two rectangular flange plates 21, 21 and a web plate 23 positioned between the two flange plates 21, 21. If necessary, one or more pairs of web stiffeners 25, 25 are respectively attached to both side surfaces of the web plate 23.

The fixture 5 comprises a bottom plate 53 and two side plates 51, 51 parallel connected to the bottom plate 53. A plurality of grooves 511 are formed on each of the side plates 51, 51. Also, a plurality of holes 321 corresponding to the grooves 511 are provided on the connecting plate 32.

Figure 2:
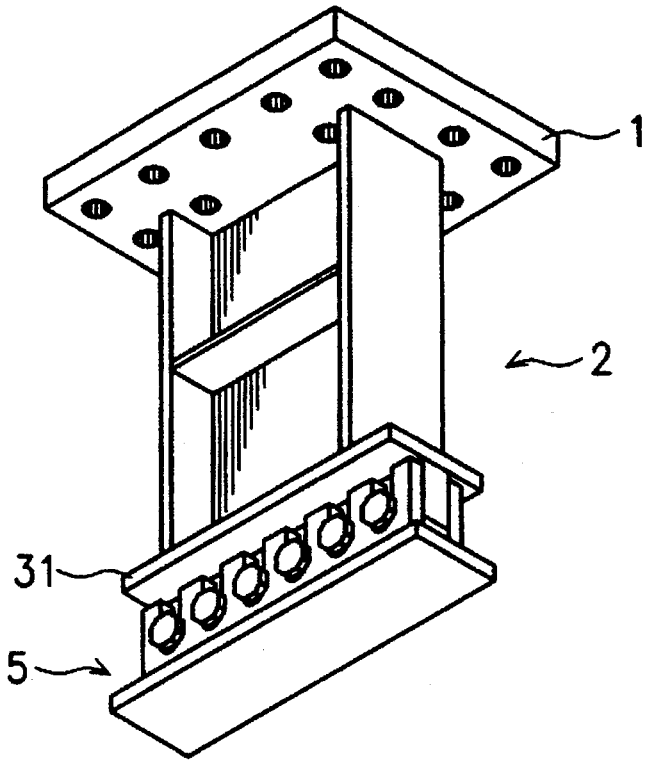
FIG. 2 shows the assembly of the shear link energy absorber according to FIG. 1.

To assemble the shear link energy absorber, one end of the I-shaped beam is connected to the base plate 1 and the other end is connected to the connecting plate 31. Then, the connecting plate 32 is perpendicularly connected to the connecting plate 31 and the connecting plate 32 is put between the two side plates 51, 51 with its holes 321 aligned with the grooves 511. Then, the bolts 4 are inserted through the grooves 511 and the holes 321 to bolt the fixture 5. It should be noticed that the bolts 4 are not tightened so that the fixture 5 is allowed to move relative to the base plate 1 in the longitudinal direction of the grooves 511. FIG. 2 shows the assembly of the shear link energy absorber according to FIG. 1.

Figure 3:
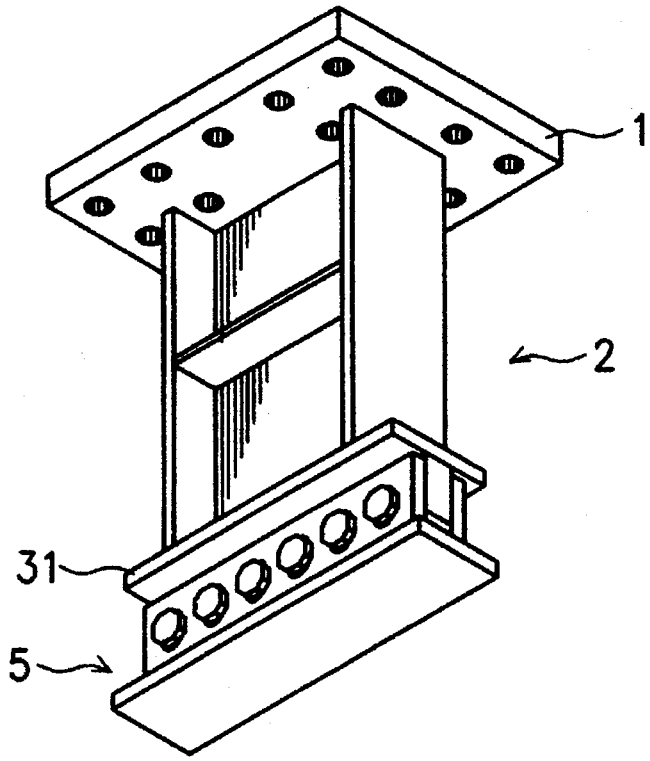
FIG. 3 shows a modification to the fixture of the first embodiment.

FIG. 3 shows a modification of the first embodiment, in which a plurality of slots, instead of grooves, are provided on each of the side plates 51, 51.

Figure 4:
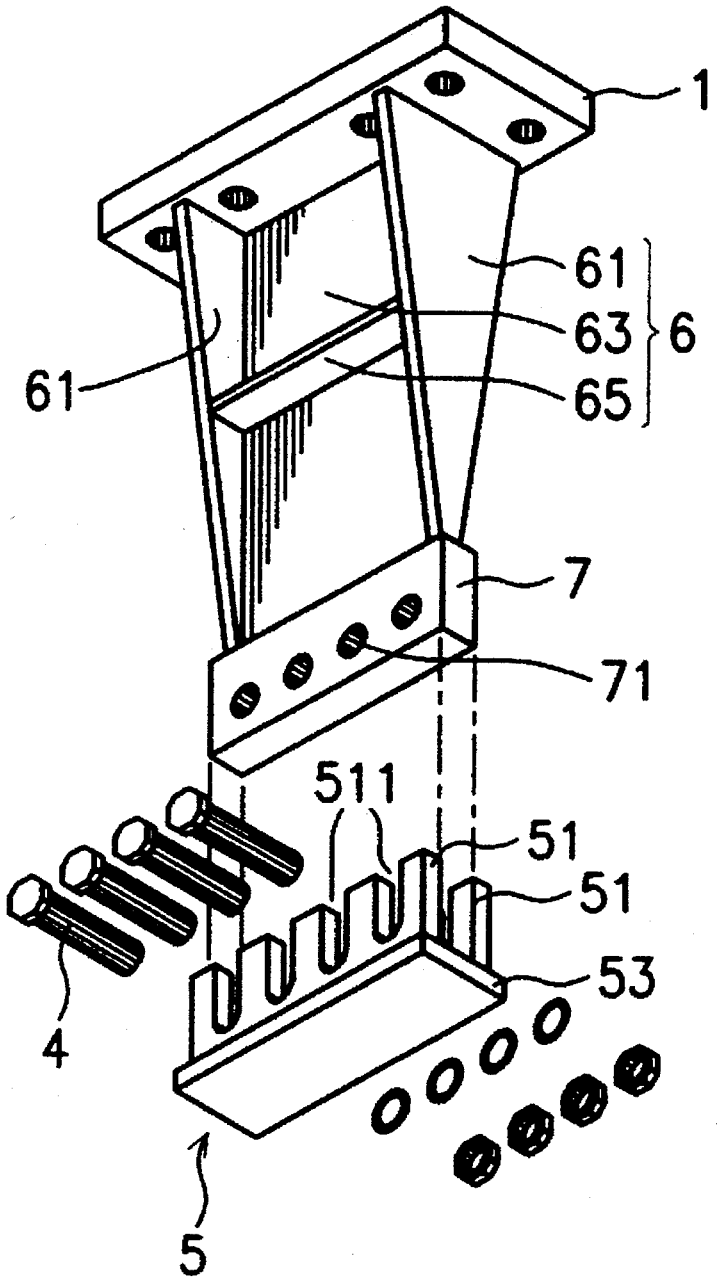
FIG. 4 is a perspective exploded diagram of the shear link energy absorber according to the second embodiment of the present invention.

FIG. 4 is an exploded perspective diagram of a shear link energy absorber according to the second embodiment of the present invention, wherein the shear link energy absorber comprises a base plate 1, an I-shaped beam 6, a connecting plate 7, a fixture 5 and a plurality of bolts 4.

The I-shaped beam 6 comprises a pair of tapered flange plates 61, 61 and a web plate 63 positioned between the flange plates 61, 61. Sometimes one or more pairs of web stiffeners 65, 65 are attached to both side surfaces of the web plate 63. A plurality of holes 71 are provided on the connecting plate 7.

The bolts 4 and the fixture 5 are the same as those of the first embodiment and therefore their descriptions are omitted.

Figure 5:
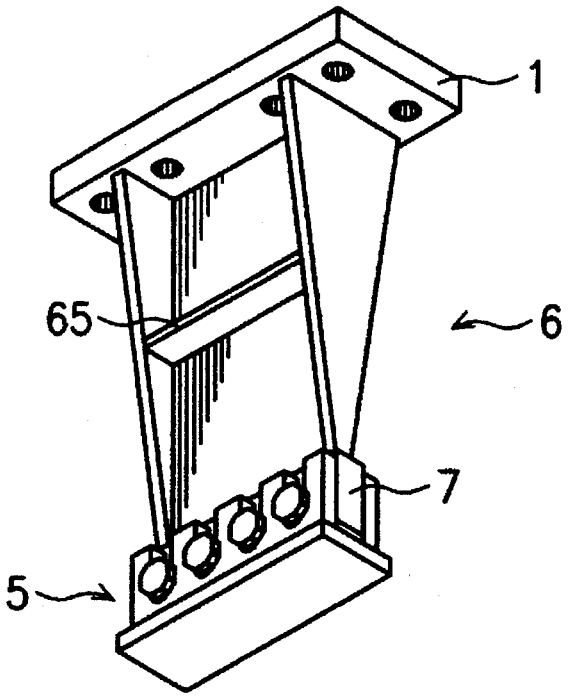
FIG. 5 shows the assembly of the shear link energy absorber according to FIG. 4.

To assemble the shear link energy absorber, the I-shaped beam 6 is connected to the base plate 1 and the connecting plate 7, wherein the wider end of the flange plate 61 is connected to the base plate 1 while the narrower end is connected to the connecting plate 7. Then, the connecting plate 7 is put between the two side plates 51, 51 with its holes 71 aligned with the grooves 511 and the bolts 4 are inserted through the grooves 511 and the holes 71 to bolt the fixture 5, but are not tightened. FIG. 5 shows the assembly of the shear link energy absorber according to FIG. 4.

Figure 6:
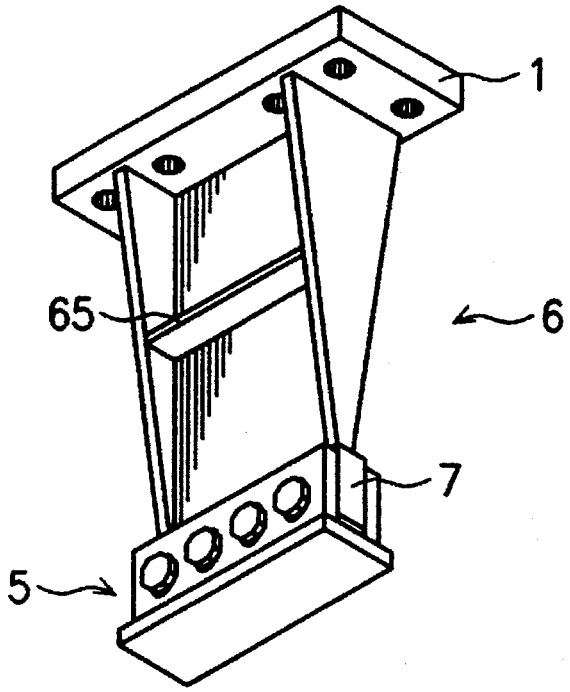
FIG. 6 shows a modification to the fixture of the second embodiment.

FIG. 6 shows a modification of the second embodiment, wherein a plurality of slots, instead of grooves, are provided on each of side plates 51, 51.

Figure 7:
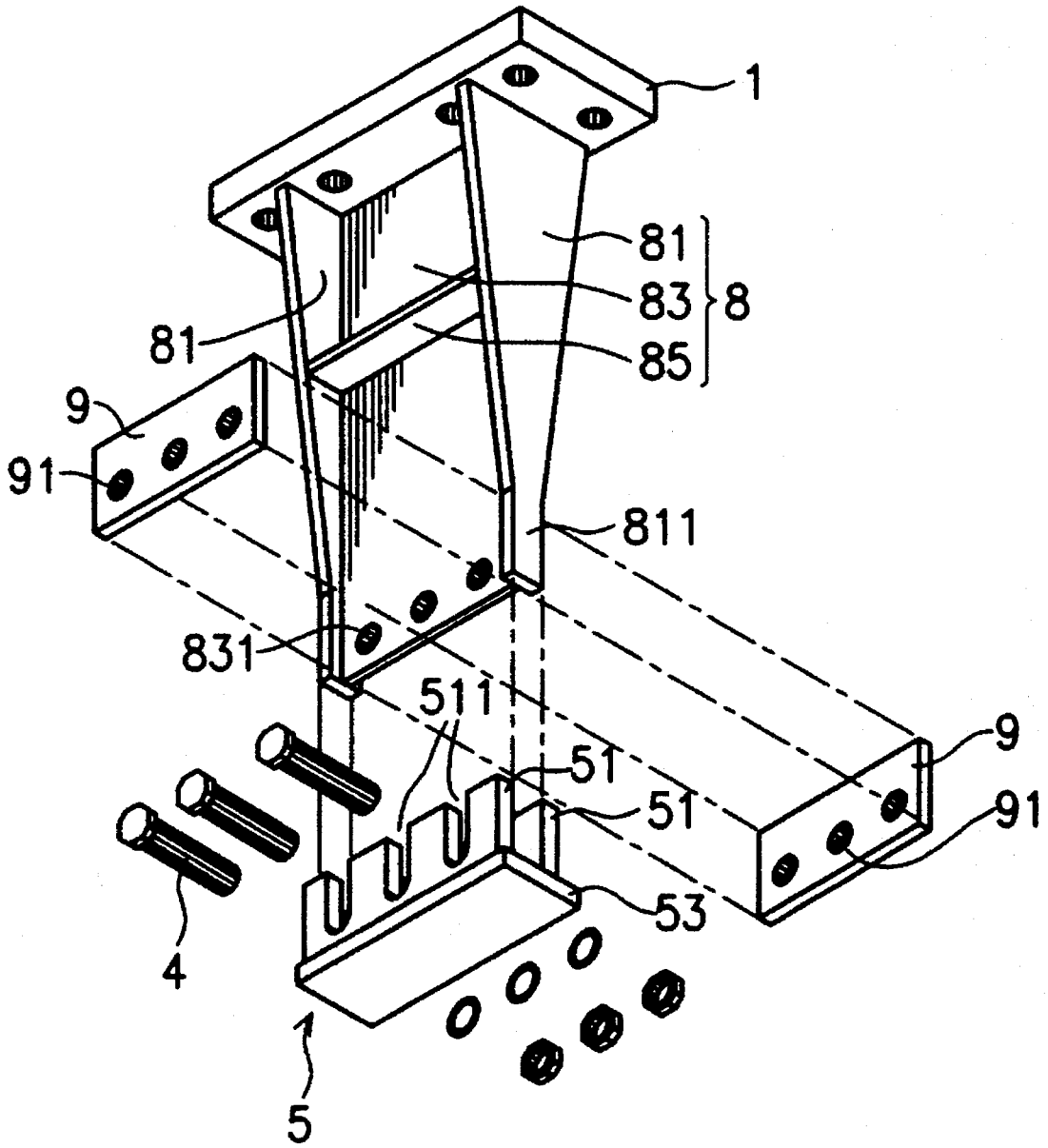
FIG. 7 is a perspective exploded diagram of the shear link energy absorber according to the third embodiment of the present invention.

As shown in FIG. 7, a shear link energy absorber according to the third embodiment of the present invention comprises a base plate 1, an I-shaped beam 8, two connecting plates 9, a fixture 5 and a plurality of bolts 4.

The I-shaped beam comprises a pair of substantially tapered flange plates 81, 81 and a web plate 83 positioned between the flange plates 81, 81. Each narrower end of the flange plates 81, 81 extends to form a rectangular section 811. One or more pairs of web stiffeners 85, 85 can be respectively attached to both side surfaces of the web plate 83, if necessary. A plurality of holes 831 are provided on the end of the web plate 83 between the two rectangular sections 811, 811. Also, another plurality of holes 91 corresponding to the holes 831 are provided on each of the connecting plates 9, 9. The bolts 4 and the fixture 5 are the same as those of the first embodiment and therefore their detailed descriptions are omitted.

Figure 8:
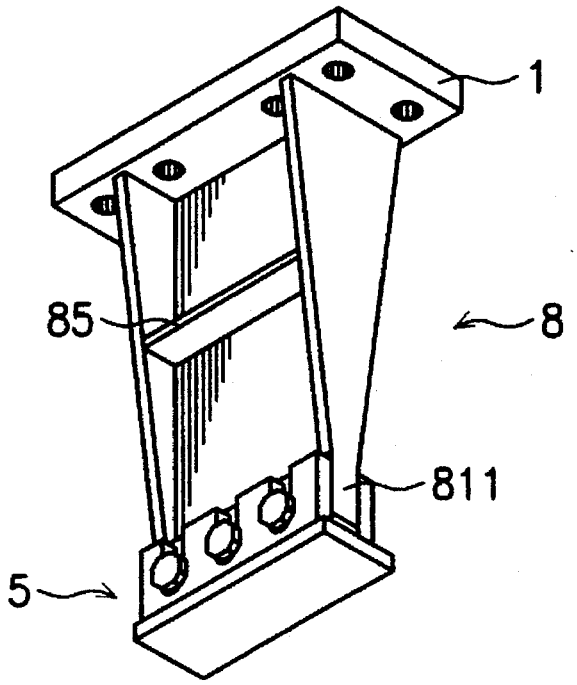
FIG. 8 shows the assembly of the shear link energy absorber according to FIG. 7.

To assemble the shear link energy absorber, the connecting plates 9, 9 are attached to both side surfaces of the web plate 83 between the two rectangular sections 811, 811. Then, the wider end of the I-shaped beam 8 is connected to the base plate 1 and the narrower end of the I-shaped beam 8 is put between the two side plates 51, 51 with its holes 91, 831 aligned with the grooves 511. Finally, the bolts 4 are inserted through the grooves 511 and the holes 91, 831 to bolt the fixture 5, but are not tightened. FIG. 8 shows the assembly of the shear link energy absorber according to FIG. 7.

Figure 9:
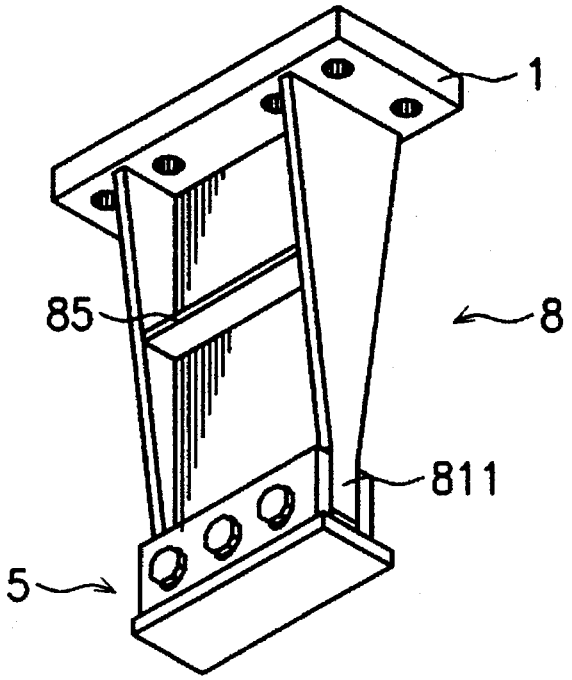
FIG. 9 shows a modification to the fixture of the third embodiment.

FIG. 9 shows a modification of the third embodiment, in which a plurality of slots, instead of grooves, are provided on each of the side plates 51, 51.

In the above embodiments, the flange plates and the web plate of the I-shaped beam can be welded together or be integrally formed by hot rolling. If welding is used, the flange plates and the web plate can be made of different materials which have different strengths to satisfy design requirements.

Application Example 1

Figure 10:
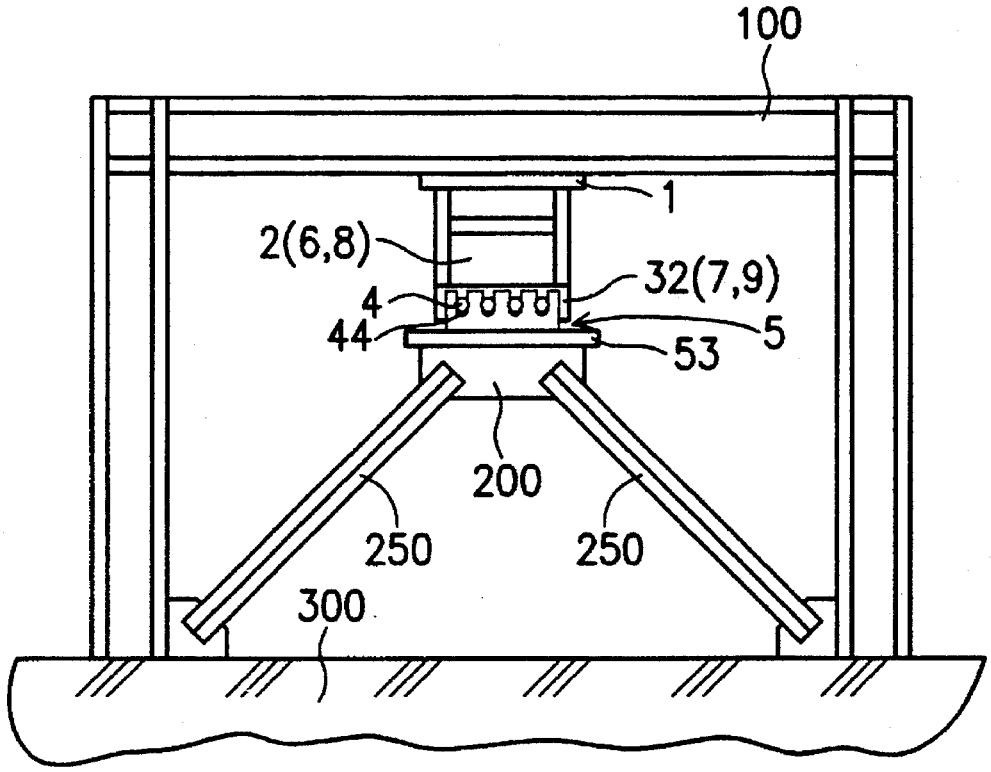
FIG. 10 shows a first application example of the present invention.

FIG. 10 shows a first application example of this invention, wherein the base plate 1 is connected to the lower surface of a beam 100 and the bottom plate 53 of the fixture 5 is connected to two struts 250, 250 through a connection 200. It is noted that a space 44 is provided between the fixture 5 and each bolt 4, in the direction perpendicular to the bottom plate 53, so that the shear link energy absorber of this invention fails to transmit vertical loads. In other words, no vertical loads resulting from gravity, such as the weight of the beam 100, are exerted on the I-shaped beam 2 (or 6, 8).

An earthquake will cause relative displacements between the upper floor 100 and the lower floor 300. At that time, the bolts 4 will move with respect to the base plate 1 and the I-shaped beam 2 (or 6, 8) deforms to dissipate seismic energy.

Application Example 2

Figure 11:
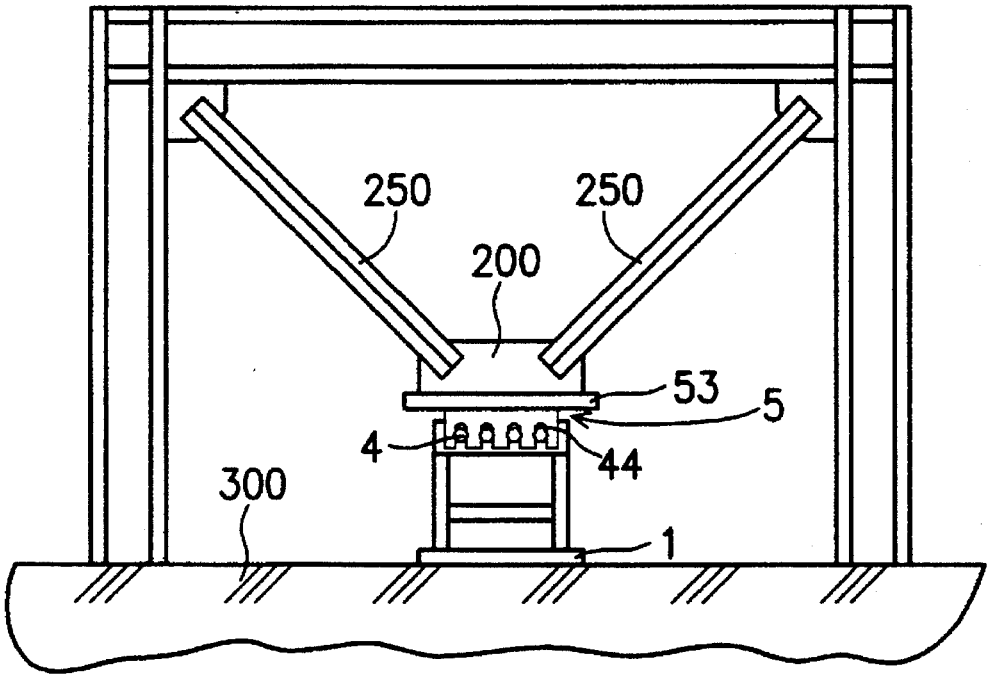
FIG. 11 shows a second application example of the present invention.

FIG. 11 shows a second application example of this invention, wherein the base plate 1 is connected to the upper surface of a beam 300 and the bottom plate 53 of the fixture 5 is connected to two struts 250, 250 through a connection 200. This arrangement does not interfere with the locations of the doors and windows of a building. A space 44 is also provided between the fixture 5 and each bolt 4 so that the bolt 4 can move with respect to the base plate 1 under the gravity load.

Application Example 3

Figure 12:
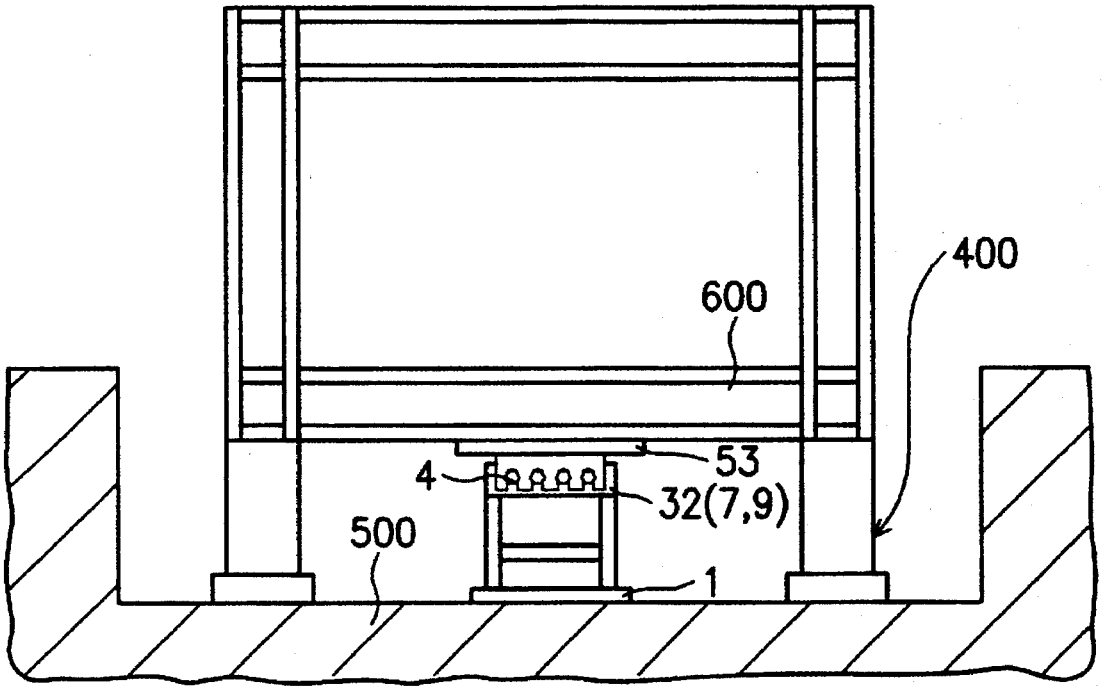
FIG. 12 shows a third application example of the present invention.

FIG. 12 shows a third application example of this invention, an application of a base isolated structure, in which the base plate 1 is connected to a base 500 and the bottom plate 53 is connected to the lower surface of a grade beam 600. By this arrangement, the damping effect of the base isolated structure can he enhanced.

The shear link energy absorber according to this invention can be applied in a new building or an existing building and is easily dismounted as well as mounted.

Although this invention has been described in its preferred forms and various examples with a certain degree of particularity, it is understood that the present disclosure of the preferred forms and the various examples can be changed in the details of construction. The scope of the invention should be determined by the appended claims and not by the specific examples given.

What is claimed is:

1. A shear link energy absorber comprising:

a beam having an I-shaped cross-section comprising a pair of flange plates and a web plate extending between said flange plates;

a fixture having a bottom plate and two parallel and spaced apart side plates connected to said bottom plate;

a base plate connected to a first end of said beam;

at least one connecting plate connected to a second end of said beam opposite said first end thereof; and a plurality of bolts bolting said connecting plate and said fixture together.

2. A shear link energy absorber as claimed in claim 1, further comprising at east one pair of web stiffeners respectively attached to both side surfaces of said web plate.

3. A shear link energy absorber as claimed in claim 1, wherein a space is provided between said fixture and each of said bolts, in the direction perpendicular to said bottom plate.

4. A shear link energy absorber as claimed in claim 1, wherein said flange plates are each substantially rectangular.

5. A shear link energy absorber as claimed in claim 1, wherein a width of said flange plates are tapered with a wider end of said flange plates being connected to said base plate and a respective narrower end of said flange plates being connected to said connecting plate.

6. A shear link energy absorber as claimed in claim 1, wherein a plurality of grooves are provided on each of said side plates, said plurality of bolts being correspondingly inserted therethrough.

7. A shear link energy absorber as claimed in claim 1, wherein a plurality of slots are provided on each of said side plates, said plurality of bolts being correspondingly inserted therethrough.

* * * * *